United States Patent [19]

Campbell

[11] 3,980,155

[45] Sept. 14, 1976

[54] FIRE ESCAPE

[76] Inventor: William Murray Campbell, Suite 331, 10637-150 St., North Surrey, British Columbia, Canada

[22] Filed: June 24, 1974

[21] Appl. No.: 482,241

[52] U.S. Cl. ..... 182/49
[51] Int. Cl.[2] ..... A62B 1/20
[58] Field of Search ..... 182/48, 47, 49; 52/187; 193/12

[56] References Cited

UNITED STATES PATENTS

| | | | |
|---|---|---|---|
| 277,156 | 5/1883 | Pardessus | 182/47 |
| 318,086 | 5/1885 | Clarke | 182/47 |
| 506,238 | 10/1893 | Kirker | 182/49 |
| 849,340 | 4/1907 | Schwab | 193/12 |
| 937,552 | 10/1909 | Rieseck | 182/48 |

*Primary Examiner*—Reinaldo P. Machado
*Attorney, Agent, or Firm*—Carver and Company

[57] ABSTRACT

Fire escape for use in multi-storied building having floors spaced generally equally from adjacent floors at floor spacing. Fire escape has fire resistant, vertical, hollow outer column and similar inner column positioned generally centrally within outer column. Outer and inner columns have generally oval-sectioned inner and outer wall respectively spaced apart to provide columnar space therebetween. Chute within columnar space follows generally helical path of essentially constant pitch of twice floor spacing so that one complete circuit of chute passes two floors. In one embodiment for wide floor spacing, inner column is hollow and has column floors disposed therein level with floors outside outer column and spiral stairway spaced above chute to follow chute with sufficient head room for persons on the chute or stairway. Person escaping enters outer column through door opening, and can descend stairs directly; or through openings in inner column can descend by chute. In second embodiment for narrower floor spacing, a columnar space contains chute and stairway arranged side by side having equal helical pitches, stairway spaced outwards from chute. Dividing wall between chute and stairway prevents interference between persons using chute or stairway. Opening through outer column permits access to stairs, and opening through dividing wall permits access to chute. In both embodiments a second complementary chute and stairway can be provided so that each embodiment has four independent escape routes.

11 Claims, 9 Drawing Figures

FIRE ESCAPE

BACKGROUND OF THE INVENTION

1. Field of the Invention

The invention relates to a fire escape particularly adapted for use in multi-storey buildings such as high-rise residential and commercial buildings.

2. Prior Art

It is well known that many high-rise commercial and residential buildings have poor or inadequate fire escape equipment. Many residential high-rise buildings are provided with balconies and, in a fire, one recommended procedure is for those persons who cannot evacuate the building easily to stand on the balcony until the fire is extinguished, or until they are evacuated by rescue equipment. Most commercial high-rise buildings are not provided with such balconies and, if such a building is on fire, common fire escapes would be used, such as interal or external stairs. It is well known that in a fire most internal staircases act as flues and commonly become smoke filled and hot and impossible to use for normal escapes. The problem of escape in commercial high-rise buildings is further compounded by the number of persons requiring to use the escaping devices. When compared with residential high-rise buildings, commercial buildings commonly have many more persons on the same floor area as a residential high-rise building. Thus, fire escape apparatus that might have sufficient capacity for a residential high-rise building is likely to have insufficient capacity for a commercial high-rise building of similar size.

Some known escape apparatus, particularly devices in which a person descends a rope hanging from the building, are often too difficult to operate for a frightened or a very old or a very young person. Further, this type of apparatus handles only a relatively small number of persons, and delays resulting from persons incapable of operating the apparatus further reduce capacity of such apparatus. This type of apparatus is often exposed to smoke, heat and flames which can render them inoperative in a short time.

SUMMARY OF THE INVENTION

The present invention reduces the difficulties and disadvantages of the prior art by providing a fire escape which can be used in residential and commercial high-rise buildings, independently of the size of the building. Further the fire escape has a high capacity for evacuating large numbers of persons, and can be used by conscious or unconscious, young, old or frightened persons. The fire escape provides a smoke-free and fire resistent column which can be exposed to fire with negligible damage and with negligible risk to persons inside.

A fire escape according to the invention is for use in multi-storied buildings in which floors are spaced generally equally from adjacent floors at a floor spacing. The fire escape has a fire resistant, vertically disposed, hollow outer column having a generally oval-sectioned inner side wall. A vertically disposed inner column is positioned generally centrally within the outer column, the inner column having a generally oval-sectioned outer side wall generally similar to and spaced from the inner side wall of the outer column, thus defining a vertically disposed columnar space between the inner and outer column. A generally helical chute is provided within the columnar space, the chute following a generally helical path of essentially constant pitch of twice the floor spacing so that one complete circuit of the chute passes two floors. Access means communicating with the chute provide access to the chute for persons escaping.

A detailed disclosure following, related to drawings, describes preferred embodiments of the invention, which however is capable of expression in structure other than that particularly described and illustrated.

DETAILED DISCLOSURE

FIGS. 1 - 3

Figure 1:
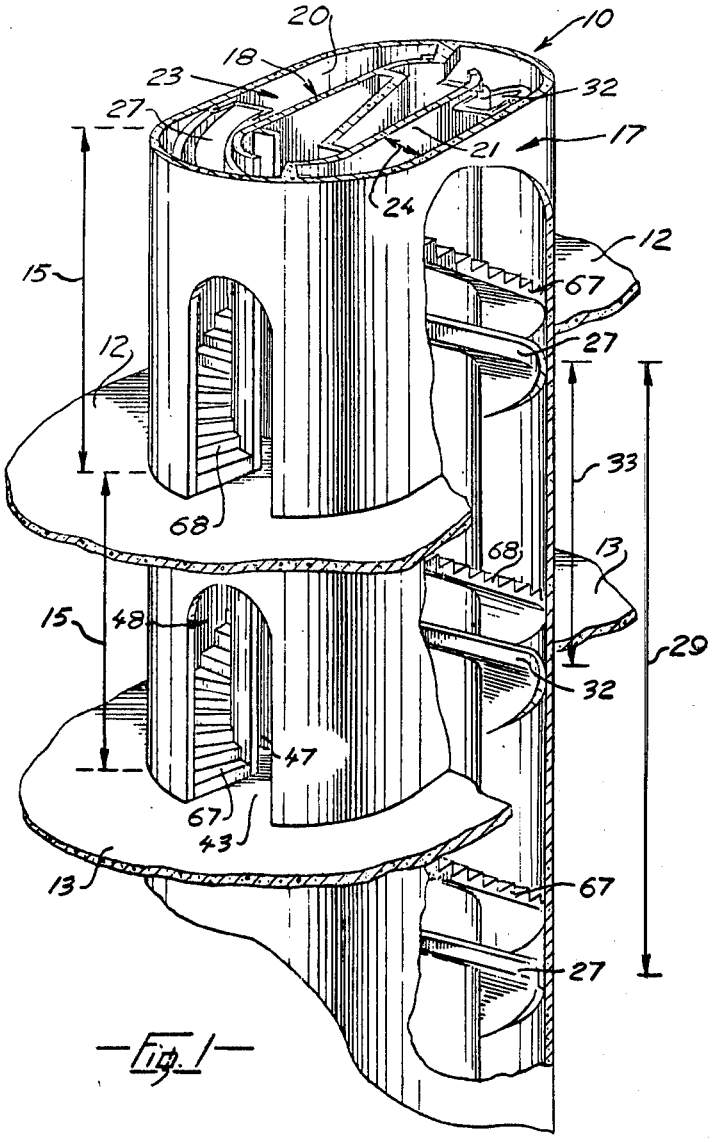
FIG. 1 is a fragmented perspective of a portion of a fire escape according to the invention, shown extending between two floors of a building.

A fire escape 10 according to the invention is for use in a multi-storied building (not shown), such as a commercial or residential high-rise building. Two adjacent floors are shown, an upper floor 12 and a lower floor 13, the floors being spaced at floor spacing 15. A floor (not shown) spaced above the floor 12 is similarly spaced at floor spacing 15, a portion of the fire escape immediately below such floor being shown. The floors are spaced generally equally from adjacent floors for reasons as will become apparent.

The fire escape has a fire resistant, vertically disposed, hollow outer column 17, and a similar vertically disposed, inner column 18 positioned generally centrally within the outer column. The outer column has a generally oval-sectioned inner side wall 20 and the inner column has a generally oval-sectioned outer side wall 21 generally similar to and spaced from the side wall 20, thus defining a vertically disposed columnar space 23 between the inner and outer columns. The columnar space has a width 24 which is sufficiently wide for stairs, typically about 3 feet 6 inches wide.

A first generally helical chute 27 is provided within the columnar space and extends between the sidewalls thereof, the chute following a generally helical path of essentially constant pitch 29. The pitch 29 is twice the floor spacing 15, so that one complete circuit of the chute passes two floors. A second generally helical chute 32 is also provided within the columnar space 23, the second chute following a path similar to the path of the first chute 27 and having a pitch equal to the pitch 29 of the first chute but spaced 180° out of phase with the first chute. Thus, as best seen in FIG. 1, the two helical chutes of equal pitch follow two independent helical paths within the columnar space, axial separation 33 between adjacent portions of the chutes being equal to the floor spacing 15, that is one half of the pitch. Each chute thus has straight portions alternating with curved portions.

Figure 2:
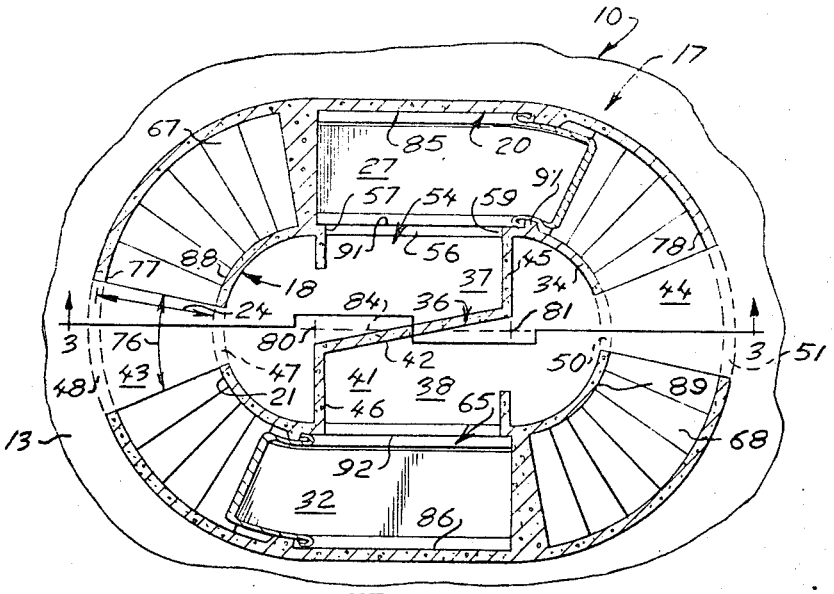
FIG. 2 is a simplified fragmented transverse section in a horizontal plane on 2—2 of FIG. 3, through a portion of the fire escape of FIG. 1.
Figure 3:
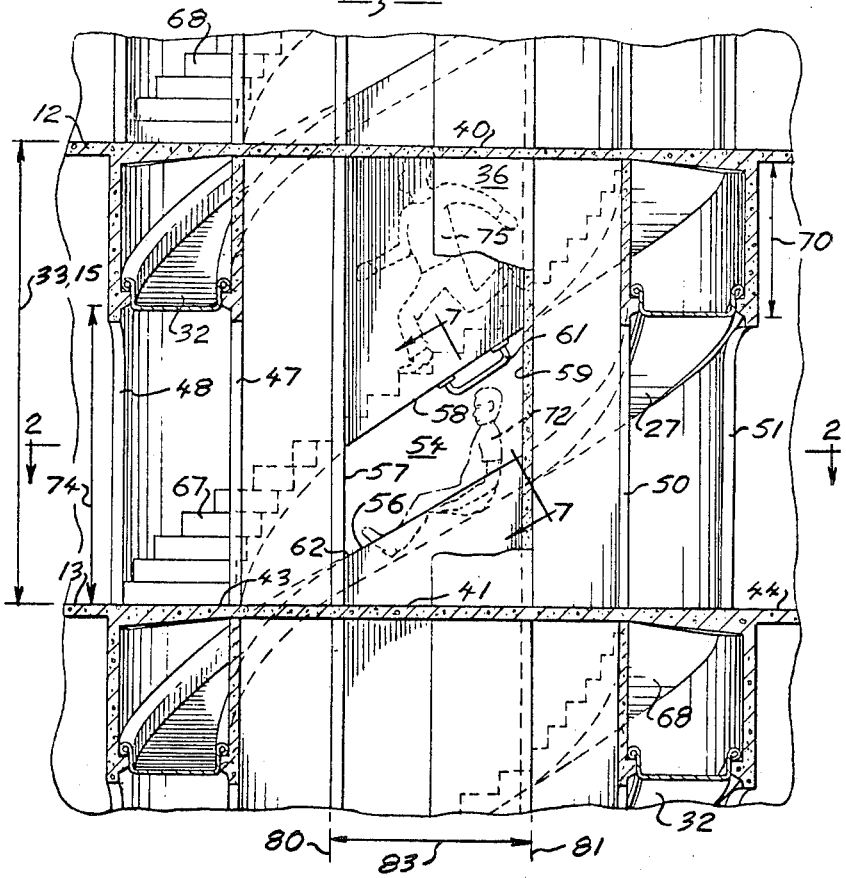
FIG. 3 is a simplified fragmented section on 3—3 of FIG. 2.

As can be seen in FIG. 2 and 3 the inner column 18 is hollow and has an inner side wall 34, defining in part an interior of the inner column. Column floors 40 and 41 extend between the inner side wall 34 and are generally level with the floors 12 and 13 respectively outside the outer column, so that each is a continuation of a particular floor. Walkways 43 and 44 extend across the columnar space between sidewalls of the inner and outer columns and level with the floor 13. The walkways 43 and 44 thus lead from the floor 13 of the building to the column floor 41 within the inner column. A partition 36 extends between the inner side wall 34 so as to divide the interior of the inner column into two separate chambers 37 and 38. The partition 36 has an inner wall member 42 and parallel outer wall members 45 and 46 extending in opposite directions from edges of the member 42. The inner and outer columns have aligned door openings 47 and 48 respectively provided above the walkway 43 to provide access to the chamber 37 in the interior of the column. Similar door openings 50 and 51 above the walkway 44 at opposite sides of the columns similarly provide access to the chamber 38. Doors (not shown) operable manually or automatically, can be provided in the door openings 47, 48, 50 and 51 so as to prevent smoke entering the fire escape.

The inner column also has a chute opening 54 to provide access to the chute 27 from the chamber 37. The opening is in a plane portion of the inner column and adjacent the chute to provide easy access. For escaping a person sits on the chute and slides down as in a common helter-skelter. The chute opening is defined by edges of side walls 56 through 59, the chute having a size sufficient to permit a person to move sideways into the chute for descending. The side wall 58 is a generally sloping upper wall of the opening and has a hand rail 61 for a person to hold prior to release for the descent. A heel stop 62 is also provided adjacent to an intesection of the side walls 56 and 57 to ease positioning of a person before release. Note that by providing the opening in the plane portion of the inner column, a person escaping positions himself prior to release on a straight portion of the chute, which is considerably easier than on a curved portion. This is one of the major advantages of the oval-sectioned chute, the straight portions of which have sufficient length to permit a person escaping to sit easily thereon, as will be described.

The chamber 38 has a similar chute opening 65 to provide access to the chute 32. Thus, from the floor 13 a person escaping can enter the escape device 10 either through the door openings 48 and 47 and the walkway 43 into the chamber 37 and then the chute 27, or through the door openings 51 and 50 and the walkway 44 into the chamber 38 and then by the chute 32. The door openings 48 and 47 and walkway 43 leading into the chamber 37 and then through the chute opening 56, and the corresponding route for the chute 32 provide access means communication with the chute to provide access to the chute for persons escaping. Each chute follows an independent path in the columnar space, the partition dividing the columns into two isolated escape routes through the columnar space so that should one chute and path become filled with smoke the remaining chute might remain free of smoke. Further the capacity of the fire escape is doubled by providing the second chute with no change in volumn occupied by the fire escape.

The versatility of the fire escape can be further increased by providing a pair of similar, generally helical first and second stairways 67 and 68 within the columnar space. The stairway 67 follows a generally helical path having an average pitch equal to the pitch 29 of the chute, the stairway 67 being spaced axially a distance 70 from the chute 27 so as to be out of phase with the chute and simultaneously to provide sufficient head room for a person 72 sitting on the chute. The axial distance 70 is effectively a phase difference between the chute and its complementary stairway. As seen in FIG. 3, the stairway 67 is also spaced from the adjacent chute 32 a distance 74 which provides sufficient headroom beneath the chute 32 for a person 75 standing on the stairway 67. Neglecting material thickness the distance 74 plus the distance 70 equals the axial separation 33 which is also the floor spacing 15. The second stairway 68 is similarly spaced axially from the chute 32, the second stairway also being spaced 180° out of phase from the first stairway. Thus the two isolated escape routes each include a complementary stairway, making a total of four independent escape routes.

Thus a person passing down the first stairway 67 crosses a walkway every half circuit, at which walkway the person could pass into one of the chambers and descend by a chute beneath the stairway 67, that is by the chute 27. To cross to the alternative chute or stairway the person would have to pass around the outside of the outer column.

Figure 4:
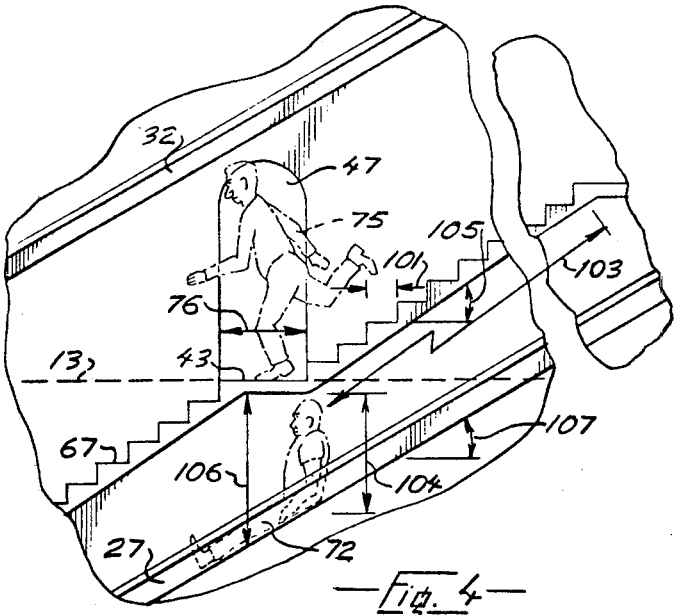
FIG. 4 is a fragmented side view of a curved portion of the fire escape projected onto a flat surface showing disposition between a chute and a staircase used in the invention.
Figure 5:
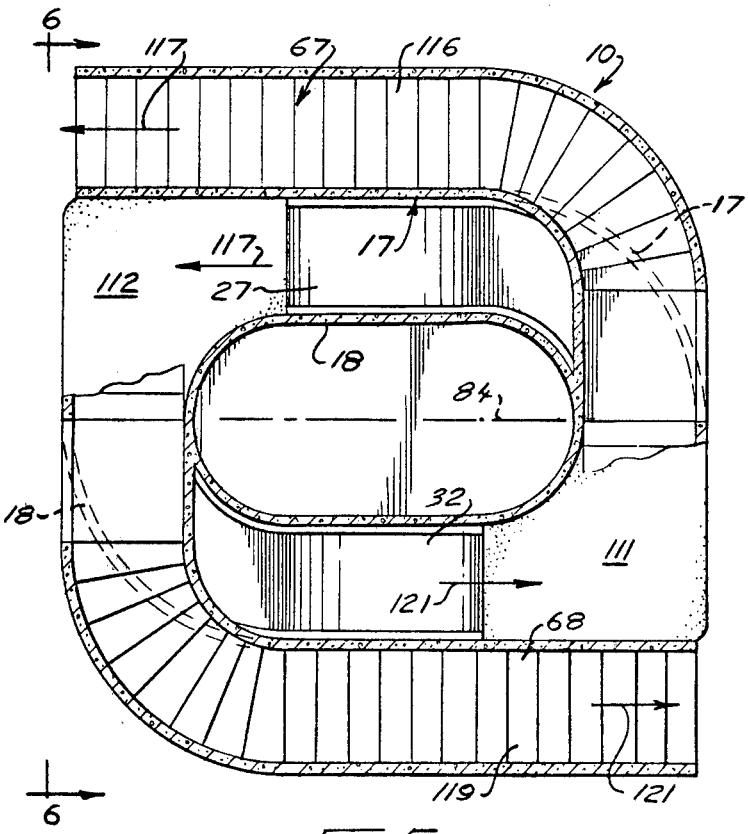
FIG. 5 is a horizontal section through a portion of the fire escape at ground floor.

The walkway 43 has a mean width 76 greater than one tread width of the stairway as defined in FIG. 5. A width 76 equal to about three tread widths has been found suitable. The walkway provides easy access into the chamber 37 and thus serves as a landing and is level with the floor 13 and the column floor 41 of the chamber 37. In some buildings with smaller floor spacings, the walkway could be narrower, but it will have a minimum width of at least one tread width, so as to permit persons to walk without difficulty from the floor outside the column into the chamber. Clearly the width 76 of the landing, which is a discontinuity in the helical path of the stairway results in a change in the slope, that is the local pitch of the stairway at the landing, which change must be compensated as will be described. The discontinuity in the helical pitch of the stairway is further described with reference to FIG. 4.

The inner side wall 20 of the outer column is characterized by a pair of spaced, opposed, semi-cylindrical concave sidewalls 77 and 78 facing each other as shown. Each side wall is centred on a respective longitudinal axis 80 and 81 respectively, which axes as seen in FIG. 3 are vertical, parallel to each other and spaced from each other at an axis separation 83. The inner wall is further characterized by a pair of spaced parallel plane inner side walls 85 and 86 extending tangentially between the concave side walls 77 and 78 so as to merge smoothly therewith, the side walls having a width equal to the axis separation 83. The geometrical shape so produced, best seen in FIG. 2, herein is referred to as "generally oval". A vertical plane containing the two axes defines a major axial plane 84 of the column, the plane side walls being disposed symmetrically about the said major axial plane and parallel thereto.

The outer side wall 21 of the inner column 18 is characterized by a pair of spaced, semi-cylindrical convex side walls 88 and 89, each convex side wall being centred on a respective longitudinal axis of the concave side wall so that the convex side walls are generally concentric with the concave side walls. The opposed convex and concave side walls are spaced apart at the passage width 24, which is equal to difference in the radii of the inner and outer side walls. A pair of spaced parallel plane outer side walls 91 and 92 extend tangentially between the pair of concave inner side walls so as to merge smoothly therewith, each plane inner side wall having a width approximately equal to the axis separation 83. Each plane inner side wall is spaced from an opposed plane outer side wall at the passage width 24 so that the columnar space 23 has an essentially constant width. Thus both chutes and stairway follow regular paths of short straight sloping portions connected by curved or helical portions of half a revolution.

The walkways 43 and 44 on the floor 13 straddle the major axial plane 84, which as seen are asymmetrical relative to the axial plane. As best seen in FIG. 2 the aligned door openings are provided in the semi-cylindrical concave and convex side walls of the columns are similarly disposed on opposite sides of the inner and outer columns, and are also spaced asymmetrically relative to the axial plane 84. As previously stated the chute openings are provided in the plane portions of the inner column, i.e. the plane walls 91 and 92, adjacent i.e. straight portions of the chutes. This is because it is far easier to enter a straight chute than a curved chute as it passes between the convex and concave side walls.

FIG. 4

As previously stated, the walkway or landing 43 has a mean width 76 greater than one tread width designated 101. Typically, the mean width 76 is equal to approximately a total of three mean tread widths and, for a horizontal landing, i.e. zero slope, this represents about one tenth of a circuit of the stairs with zero axial displacement. Thus, to maintain equal average pitches for the chute and stairway, a portion 103 of the stairway 76 between adjacent walkways has an actual helical pitch or a slope greater than average helical pitch or slope of circuit of the stairway to compensate for the zero axial displacement. Clearly, to maintain an essentially constant spacing between chute and stairway for several circuits of the stairway, the stairway must have an average pitch equal to the pitch of the chute, the pitch of the chute being constant. Thus to maintain a sufficient minimum headroom between the chute 62 and the complementary stairway 67, a local axial spacing or phase difference 104 between the chute and stairway, measured vertically at one side of walkway provides less headroom than a local axial spacing 106 at the opposite side of the walkway. The spacing 104 represents the minimum headroom for the chute and should be no less than 3 feet 3 inches. The spacing 106 represents maximum headroom for the chute, about 4 feet 3 inches, and correspondingly represents a position of minimum headroom for a person on the stairway above, which minimum should be no less than 6 feet. The portion 103 of the stairway is inclined to the horizontal at an angle 105, typically about 33½°. The chute 62, at a constant pitch throughout the length of the fire escape, is inclined to the horizontal at an angle 107, which angle for a normally polished metal chute is about 30°. Thus the angle 105 is somewhat greater than the angle 107, selection of which difference compensates for the greater average pitch of the stairway and level area of walkway or landing width.

Figure 6:
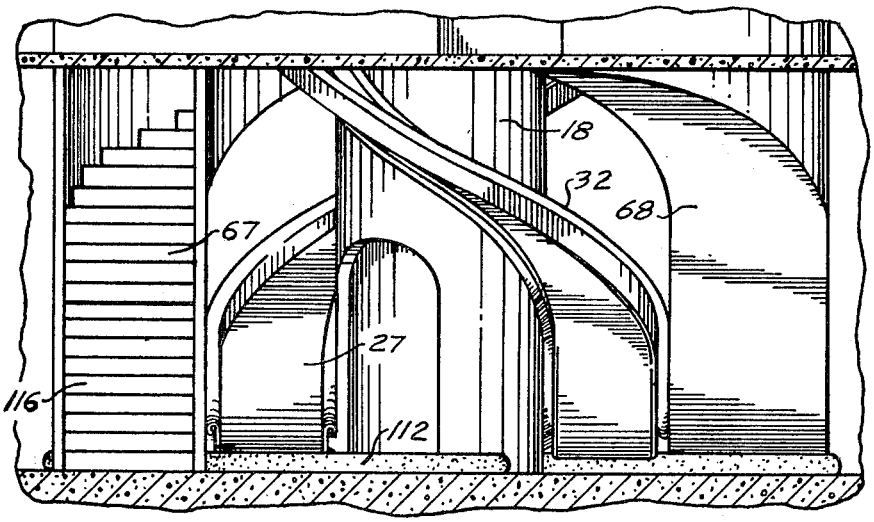
FIG. 6 is a fragmented simplified end elevation, as seen from 6—6 of FIG. 5, showing exits from the fire escape at ground floor.
Figure 7:
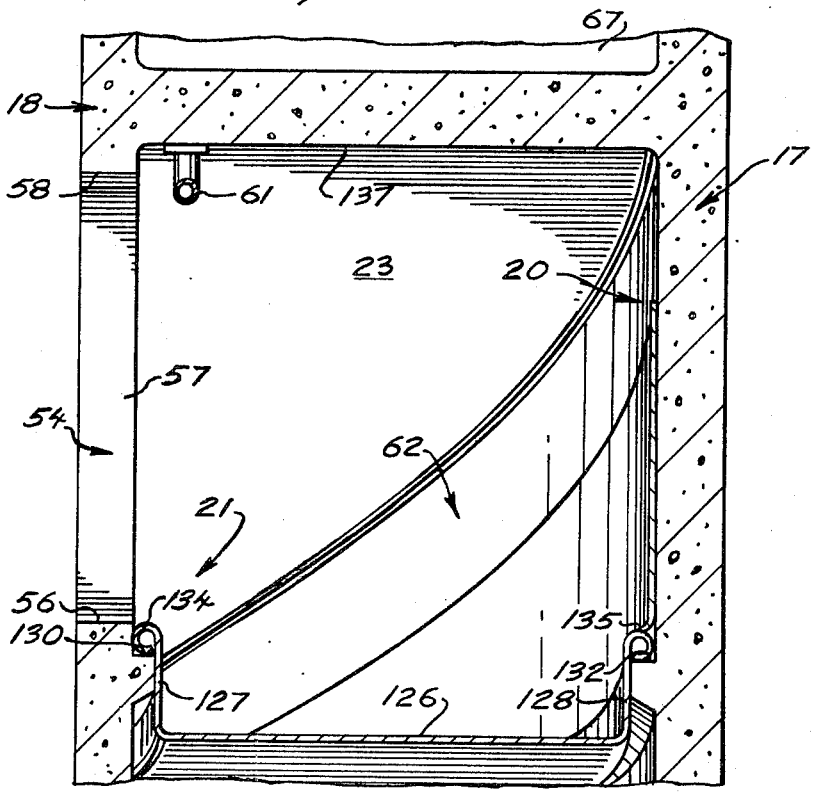
FIG. 7 is a fragmented section on 7—7 of FIG. 3, showing access means into the chute.

FIGS. 5 and 6

At a base of the fire escape, usually ground floor of a high-rise building, relative disposition between a stairway and its complementary chute change so as to permit both chute and stairway to discharge persons escaping at adjacent locations. The inner column 18 and chutes 27 and 32 remain unchanged essentially throughout their length, and have a similar shape at the ground floor as shown. The chute access openings for the lower portion of the chute can be eliminated or can be enlarged to door opening size to provide a room under the chute. Chute exits or discharge platforms designated 111 and 112 are provided at lower ends of the chutes 32 and 62 respectively. The platforms are covered with a suitable resilient material to provide cushioning for persons descending the chute and stopping their descent fairly abruptly. The stairway 67, spaced above the chute 27, changes its normal course of following the chute, as defined by the outer column 17 shown in broken outline, and diverges outwards from the column so that an exit portion 116 of the stairway is disposed generally parallel to the major axial plane 84 and transversely of the chute 27 and generally parallel to the straight portion thereof. Thus persons leaving the chute and its complementary stairway can leave in the same direction and at the same side of the buildings, direction of discharge being shown as arrows 117. Similarly, an exit portion 119 of the stairway 68 is disposed transversely of the chute 32 and parallel to the plane 84 so that persons exiting from the chute 32 and the stairway 68 leave in direction of arrows 121. As can be seen two of the escape routes discharge in the same direction from one side of the building, and two of the routes discharge in an opposite direction on an opposite side of the building, thus reducing congestion adjacent the base of the fire-escape. Alternative means of terminating the chute and staircase can be substituted.

FIG. 7

The stairways are made from a fire resistant material, such as concrete, and the chute is made preferably from formed sheet steel and polished uniformly to maintain an essentially constant slide speed. The chute has a generally flat base 126 and a pair of spaced, parallel, upwards extending side walls 127 and 128. The outer wall 21 of the inner column 18 has a generally helical shoulder 130 extending inwards into the columnar space 23 and following the helix of the chute. The inner side wall 20 of the outer column 17 has a similar shoulder 132 extending inwards into the columnar space and spaced parallel with and generally level with the shoulder 130. The side walls 127 and 128 of the chute have outwardly rolled upper edges 134 and 135 respectively, which edges are adapted to engage the shoulders so as to support the chute thereon. This provides a upper edge of the chute which is resistant to distortion, easy to manufacture, relatively easy to install in short helical and straight sections, and also provides a low hand rail where the chute passes the access opening, the typical opening 54 being shown. The handrail 61 is shown secured to lower surface 137 of the stairs 67, and clearly other means of helping persons escaping to position themselves within the chute can be provided. The opening 54 can be provided with a remotely operably door (not shown) which would reduce or substantially eliminate smoke entering the chute, should smoke from outside the outer column enter the chambers through the aligned door openings.

DIMENSIONAL CONSIDERATIONS

The fire escape 10 of FIG. 1 is particularly for use in buildings having a floor spacing 15 of about 11 feet or more. Such a spacing is typical in modern North American commercial high-rise buildings. The angle 107 of the chute can be about 30° which permits enclosing the fire escape within a generally oval-sectioned concrete column having a length of about 18 feet and width of about 12 feet 6 inches when the columnar space is 3 feet 6 inches wide. It can be seen that each straight portion of the chute is thus about 5 feet long, which is considered of sufficient length to permit a person escaping to enter and sit easily thereon to position himself prior to release.

A convenient size of step has a 10 inch mean tread width and a 6⅝ inch riser which provides sufficient space for 19 treads, that is 20 risers between adjacent landings having a mean width of three mean tread widths. With reference to FIG. 4, as previously stated the angle 105 is about 33½°, although other angles can be selected, the angle being dependent mainly on the width of landing required.

OPERATION

The fire escape requires organization of persons escaping, as opposed to skill on the part of the persons escaping. Persons using the stairway, which is as previously stated is within the fire resistant outer column 17, proceed downwards as in a normal fire escape, there being a choice of two separate stairways depending on which door one enters. The chute requires some organization to avoid congestion within the chute and possible injury due to collisions within the chute. Preferably all persons from the floor most threatened by the fire should be evacuated first, descending the chute in orderly manner and spread apart at about 10 second intervals. The persons can slide down the chute in their normal clothing, but because frictional drag due to different clothing materials can result in widely different speeds of the descent, difficulties and collisions can arise. These differences can be reduced by providing each person with a suitable mat to sit on so that variations in friction are reduced. A public address system (not shown) is provided in each chamber so as to inform persons when to evacuate. This is to reduce chances of collisions that might otherwise occur when a person entering a chute from a lower floor is hit by a person who entered the chute from a floor above. If necessary, remotely-controlled doors (not shown) can be fitted on each chute access door so as to physically prevent persons from entering the chute until required to do so.

ALTERNATIVES AND EQUIVALENTS

Figure 8:
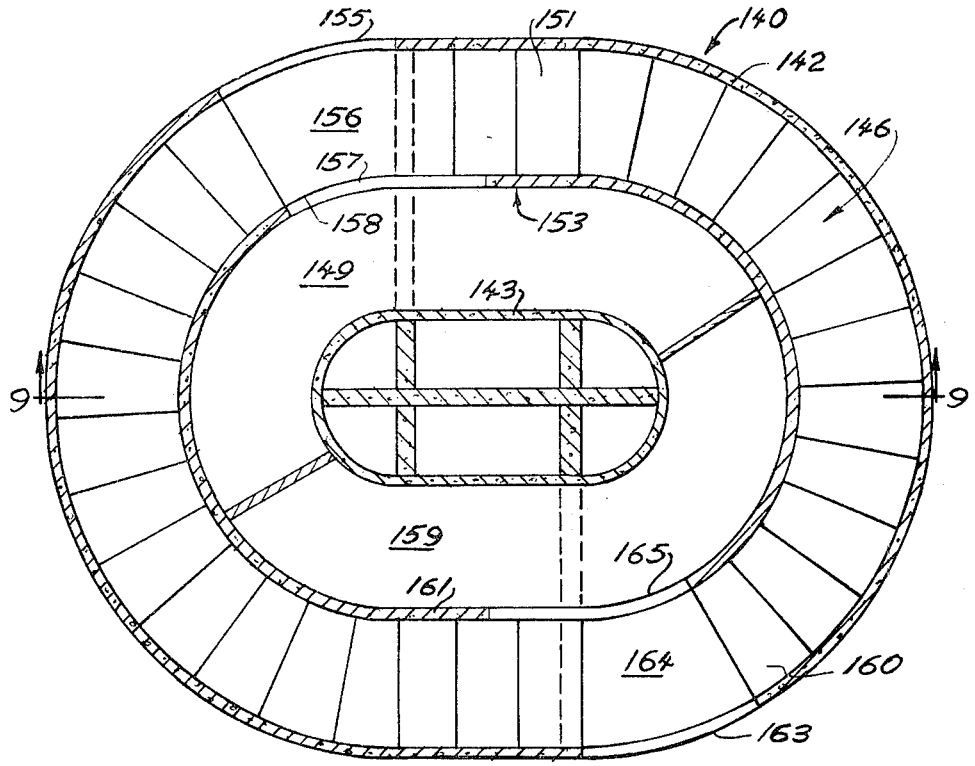
FIG. 8 is a simplified transverse section through an alternative fire escape, in which chutes and staircases are arranged side by side.
Figure 9:
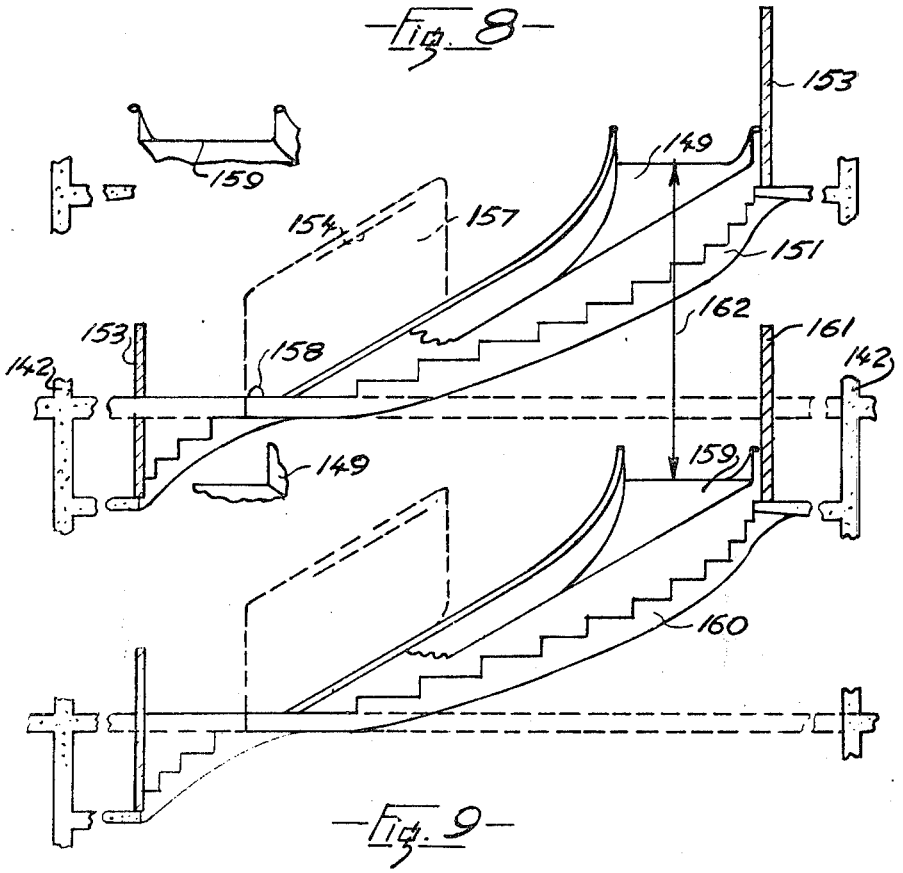
FIG. 9 is a simplified fragmented section on 9—9 of FIG. 8, partially diagramatic, and showing relative positions of chute and staircase.

FIGS. 8 and 9

An alternative fire escape 140 is particularly adapted for use in multi-storied buildings in which floors are spaced generally equally from adjacent floors at a floor spacing of less than 11 feet, which spacing is the minimum practical spacing for use of the fire escape 10. The fire escape 140 can be used in residential high-rise buildings in which floor spacing can be as little as 8 feet 6 inches. The fire escape 140 has a fire resistant, vertically disposed, hollow outer column 142, and a vertically disposed inner column 143 positioned generally centrally within the center column. The columns 142 and 143 have similar, generally oval-sectioned inner and outer side walls respectively spaced apart so as to define a vertically disposed columnar space 146 between the columns, similar to space 23 of FIG. 1.

A first generally helical chute 149 is provided in the columnar space and is similar to the chute 27 in FIG. 1 following a generally helical path of essentially constant pitch of twice the floor spacing so that one circuit of the chute passes two floors. The above refers to a structure very similar to the simple fire escape of FIG. 1.

The fire escape further includes a generally helical stairway 151 adjacent to the chute 149 in the columnar space, the stairway having a pitch equal to the pitch of the chute and generally in phase with the chute. The stairway is spaced radially outwards from the chute so that both the chute and stairway follow similar paths in the columnar space. A generally helical dividing wall 153 is provided between the stairway and the chute so as to prevent essentially interference between persons using the chute and persons using the stairway. In a first structure as shown the dividing wall extends upwards to the chute and stairway above and is thus a similarly oval-sectioned wall dividing the columnar space into two similar, generally concentric spaces. The outer column has a door opening 155 at a particular floor to provide access to the stairway, a walkway 156 extending across the stairway from the door opening to the dividing wall. The dividing wall has a dividing wall door opening 157 aligned with the door opening 155 to permit a person to gain access to the chute. A heel-stop 158 and a hand rail 154 (broken outline) are positioned adjacent the opening 157 to permit a person to ready himself prior to releasing for sliding down the chute. Thus by entering through the door opening 155 a person can descend the stairway 151, or if desired can cross the stairway by the walkway 156 and pass through the dividing wall door opening 157 and into the chute 149 for an alternative descent. Doors (not shown) are provided in the openings to restrict passage of smoke or heat.

Alternatively, in a second embodiment, the dividing wall does not extend to the stairway and the chute above but is relatively low so as to permit stepping thereover into the chute when required. Thus one can enter the chute anywhere from the stairway, which contrasts with the first embodiment in which the dividing wall door openings are spaced 180° apart, that is one on each floor. One disadvantage with the second embodiment with the low dividing wall is that the chute and associated stairway would be within the same space, and thus would share the same air space and thus would loose independence of air. With shared air space as above, the chute and complementary stairway would be more prone to being rendered inoperative by smoke contamination. When the dividing wall extends upwards to the upper adjacent chute and stairway above, two independent passages are maintained with a greater chance of at least one passage being free of smoke.

A second generally helical chute 159, a complementary stairway 160 and dividing wall 161 are similarly provided within the columnar space 146 and follow a path similar to the path of the first chute, and are spaced 180° out of phase with the first chute. Thus there are two helical chutes of equal pitch, each following a similar generally helical path within the columnar space, each chute having a complementary stairway and dividing wall. Axial separation 162 between adjacent points of the chutes, or on the complementary stairways provides clearance for persons on the chutes and on the stairway.

The outer column 142 has a second door opening 163 at the same floor level as the opening 155, the second door opening providing access to the second stairway and being spaced on an opposite side of the outer column from the first door opening 155. Access to the chute 159 is across the stairway 160 by a similar second walkway 164 to a dividing wall door opening 165 in the dividing wall, aligned with the door opening 165.

The walkway 156 has a width greater than one tread width, and thus serves as a landing in the stairway for ease of entry into the chute through the dividing wall opening 157. Similarly to the stairway of FIG. 1, the stairway 151 has an average pitch equal to the average pitch of the chute 149 so as to maintain the chute and stairway in phase. A portion of the stairway between adjacent landings has an average pitch slightly greater than the average pitch of the stairway to compensate for the landing 156. This is not illustrated but it is similar to the arrangement shown in FIG. 4. Because of the relatively larger perimeter of the stairway 156 over the stairway 67 (FIG. 1), tread width of the stairway 156 can be 20 inches with 6⅝ inch risers.

The alternative fire escape 140 is used in a manner similar to the fire escape 10 and has a similar average slope of the chute so as to maintain reasonable speeds when sliding down the chute. Note that the inner column can be solid, or if required could provide a vertical conduit for electrical, air conditioning or heating facilities as required. Note that access into the chute is from an outer wall of the chute and chambers within the inner column are not necessary for entry into the chute. Thus such a fire escape is slightly quicker to use than the escape 10 of FIG. 1. The chute and stairway are shown to be generally level so as to facilitate entry from one into the other, however they could be spaced vertically apart if required.

Because the chutes and stairways are arranged side by side, permitting use in small floor spacing, horizontal cross-sectional area is increased to a minimum of about 24 feet along a major axis and 19 feet across a minor axis.

I claim:

1. A fire escape for use in a multi-storied building in which floors are spaced generally equally from adjacent floors at a floor spacing, the fire escape comprising:

a. a fire resistant, vertically-disposed hollow outer column having a generally oval-sectioned inner side wall, b. a vertically disposed inner column positioned generally centrally within the outer column, the inner column having a generally oval-sectioned outer side wall generally similar to and spaced from the inner side wall of the outer column, thus defining a vertically disposed columnar space between the inner and outer columns, c. a first generally helical chute provided within the columnar space, the chute following a generally helical path of essentially constant pitch of twice the floor spacing so that one complete circuit of the chute passes two floors, d. the inner column being hollow and having an inner side wall defining an interior of the inner column, e. access means to the chute for persons escaping, said access means at each floor level comprising:

a column floor extending between the inner side wall of the inner column and being generally level with and corresponding to the floor outside the outer column, a walkway extending across the columnar spaced between the inner and outer columns at each floor level, the walkway leading from a particular floor of the building to the column floor within the inner column, the walkway passing between and being spaced from adjacent portions of the chute in the columnar space to provide clearance for a person on the walkway, and for a person on the chute, the inner and outer columns being provided with aligned door openings above the walkway to provide access to the interior of the inner column, the inner column also having a chute opening adjacent the chute to provide access to the chute from the interior of the inner column.

2. A fire escape as claimed in claim 1 further including:

i. a generally helical stairway provided within the columnar space, the stairway following a generally helical path having an average pitch equal to the pitch of the chute, the stairway being spaced axially from the chute so as to be out of phase with the chute to provide sufficient head room for persons standing on the stairway and for persons sitting on the chute, and in which:

i. the walkway on each floor includes one tread of the stairway, ii. the door opening in the outer column also provides access to the stairway.

3. A fire escape as claimed in claim 2 in which:

i. the walkway is a landing in the stairway level with each floor, the landing having a mean width greater than one tread width of the stairway to provide easy access into the interior of the inner column, ii. a portion of the stairway between adjacent landings has an actual helical pitch greater than average pitch of the stairway so that for a complete circuit of the stairway the stairway has an average pitch equal to pitch of the chute so as to maintain sufficient headroom between the chute and the stairway.

4. A fire escape as claimed in claim 1 further including:

i. a second generally helical chute provided within the columnar space, the second chute following a path similar to the path of the first chute and having a pitch equal to the pitch of the first chute but spaced 180° out of phase from the first chute, thus providing two helical chutes of equal pitch following two independent helical paths within the columnar space, clearance being provided between adjacent portions of the chutes to provide clearance for persons on the chutes, ii. first and second generally helical stairways provided in the columnar space, the stairways having average pitches equal to the pitch of the helical chutes and following paths similar to the paths of the helical chutes, the stairways being spaced axially from the chutes so as to be out of phase with the chutes to provide sufficient headroom for persons standing on the stairway and for persons sitting on the chute, the second stairway being spaced 180° out of phase from the first stairway;

and in which:

iii. the inner side wall of the outer column is characterized by: a pair of spaced, opposed semi-cylindrical concave side walls facing each other, each side wall centred on a respective longitudinal axis, the longitudinal axes being vertical, parallel to each other and spaced from each other at an axis separation; a pair of spaced parallel plane inner side walls extending tangentially between the pair of concave side walls so as to merge smoothly therewith, the side walls having a width equal to the axis separation, a vertical plane containing the two axes defining a major axial plane of the column, iv. the outer side wall of the inner column is characterized by: a pair of spaced semi-cylindrical convex side walls, each convex side wall centred on a respective longitudinal axis of the concave side wall so that the convex side walls are generally concentric with the concave sidewalls, opposed convex and concave side walls being spaced apart at a passage width equal to the difference in radii of the inner and outer side walls; a pair of spaced parallel plane outer side walls extending tangentially between the pair of concave inner side walls so as to merge smoothly therewith, the side walls having a width approximately equal to the axial separation, each plane inner side wall being spaced from an opposed plane outer side wall at the passage width so that the columnar space has an essentially constant width, v. the walkway on each floor straddles the major axial plane of the columns and passes beneath a portion of a chute spaced above the walkway to provide sufficient headroom for a person standing on the walkway.

vi. aligned door openings are provided in the semi-cylindrical side walls of the columns, on opposite sides of the inner and outer columns.

5. A fire escape as claimed in claim 4 further including:

i. a partition extending between the inner side wall of the inner column so as to divide the interior into two separate chambers, and in which:

ii. the aligned door openings on a particular floor provide access to one chamber, and opposite aligned door openings on the same floor provide access to the remaining chamber, so that each chamber provides access to a particular chute from a particular walkway, the partition dividing the columns into two isolated escape routes through the columnar space, each route having a chute and a complementary stairway.

6. A fire escape for use in a multi-storied building in which floors are spaced generally equally from adjacent floors at a floor spacing, the fire escape comprising:

a. a fire resistant, vertically-disposed hollow outer column having a generally oval-sectioned inner side wall, b. a vertically-disposed inner column positioned generally centrally within the outer column, the inner column having a generally oval-sectioned outer side wall generally similar to and spaced from the inner side wall of the outer column, thus defining a vertically disposed columnar space between the inner and outer columns, c. a first generally helical chute provided within the columnar space, the chute following a generally helical path of essentially constant pitch of twice the floor spacing so that one complete circuit of the chute passes two floors, d. access means communicating with the chute to provide access to the chute for persons escaping, e. a generally helical stairway adjacent the chute in the columnar space, the stairway having an average pitch equal to the pitch of the chute and generally in phase with the chute, the stairway being spaced radially outwards from the chute, f. a generally helical dividing wall being provided between the stairway and the chute so as to prevent essentially interference between persons using the stairway and persons using the chute, g. said access means comprising:

a door opening in the outer column at each floor level to provide access to the stairway, dividing wall access means aligned generally with the door opening, a walkway having a width of at least one tread width extending across the stairway from the door opening to the dividing wall access means, to provide access to the chute.

7. A fire escape as claimed in claim 6 further including:

i. second generally helical chute, stairway and dividing wall provided within the columnar space, relative positions between the first and second chutes, stairways and dividing walls being similar, the second chute following a path similar to the path of the first chute and having a pitch equal to the pitch of the first chute but spaced 180° out of phase from the first chute, so as to provide two helical chutes of equal pitch following two independent helical paths within the columnar space, the chutes having complementary stairways and dividing walls, axial clearance being provided between adjacent portions of the chutes and stairways to provide clearance for persons on the chutes and persons on the stairways, and the access means further includes:

ii. the outer column having a second door opening at each floor level, the second door opening providing access to the second stairway and being spaced on an opposite side of the outer column from the first door opening, iii. a second dividing wall access means aligned generally with the second door opening, iv. a second walkway having a width of at least one tread width extending across the second stairway from the second door opening to the second dividing wall access means to provide access to the second chute.

8. A fire escape as claimed in claim 6 in which:

i. the walkway is a landing in the stairway level with each floor, the landing having a mean width greater than one tread-width of the stairway to provide easy access into the interior of the inner column, ii. a portion of the stairway between adjacent landings has an actual helical pitch greater than average pitch of the stairway so that for a complete circuit of the stairway the stairway has an average pitch equal to pitch of the chute so as to maintain sufficient headroom between the chute and the stairway.

9. A fire escape for use in a multi-storied building in which floors are spaced generally equally from adjacent floors at a floor spacing, the fire escape comprising:

a fire resistant, vertically disposed hollow outer column having a generally oval-sectioned inner side wall, a vertically disposed inner column positioned generally centrally within said outer column, said inner column having a generally oval-sectioned outer side wall generally similar to and spaced from the inner side wall of said outer column thus defining a vertically disposed columnar space between said inner and outer columns, a first generally helical chute provided within said columnar space, said chute following a generally helical path of essentially constant pitch of twice the floor spacing so that one complete circuit of the chute passes two floors, said chute having straight portions alternating with curved portions, the straight portions having sufficient length to permit a person escaping to sit easily therein, access means for providing access to said chute for persons escaping comprising: a plurality of apertures in one of said columns of sufficient size to permit escaping persons to pass through, one of said apertures being located at alternating ones of the floors and positioned over straight portions of said chute, and walkways extending from positions adjacent said apertures to their respective said alternating floors.

10. A fire escape as claimed in claim 9 further including:

i. a second generally helical chute provided within the columnar space, the second chute following a path similar to the path of the first chute and having a pitch equal to the pitch of the first chute but spaced 18° out of phase with the first chute, so as to provide two helical chutes of equal pitch following two independent helical paths within the columnar space, clearance being provided between adjacent portions of the chutes to provide clearance for persons on the chutes.

11. A fire escape for use in a multi-storied building in which floors are spaced generally equally from adjacent floors at a floor spacing, the fire escape comprising:

a fire resistant, vertically disposed hollow outer column having a generally oval-sectioned inner side wall, a vertically disposed inner column positioned generally centrally within said outer column, said inner column having a generally oval-sectioned outer side wall generally similar to and spaced from the inner side wall of said outer column thus defining a vertically disposed columnar space between said inner and outer columns, a first generally helical chute provided within said columnar space, said chute following a generally helical path of essentially constant pitch of twice the floor spacing so that one complete circuit of the chute passes two floors, said chute having straight portions alternating with curved portions, the straight portions having sufficient length to permit a person escaping to sit easily therein, said inner column being hollow, access means for providing access to said chute for persons escaping comprising: a plurality of apertures in said inner column of sufficient size to permit escaping persons to pass through, one of said apertures being located in alternating ones of the floors and positioned over straight portions of said chute, and walkways extending from positions within said inner column adjacent said apertures to their respective said alternating floors.

* * * * *